US006172291B1

(12) United States Patent
Takegawa

(10) Patent No.: US 6,172,291 B1
(45) Date of Patent: Jan. 9, 2001

(54) DRUM PEDAL SYSTEM WITH INTERCHANGEABLE CAM ELEMENTS

(75) Inventor: Akito Takegawa, Chiba (JP)

(73) Assignee: Pearl Music Instrument Co, Chiba (JP)

( * ) Notice: Under 35 U.S.C. 154(b), the term of this patent shall be extended for 0 days.

(21) Appl. No.: 09/375,413

(22) Filed: Aug. 17, 1999

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | |
|---|---|---|---|
| 3,797,356 | 3/1974 | Duffy et al. | 84/422.1 |
| 4,346,638 | 8/1982 | Hoshino | 84/422.1 |
| 4,756,224 | 7/1988 | Lombardi | 84/422.1 |
| 5,398,584 | 3/1995 | Liao | 84/422.1 |
| 5,613,275 | 3/1997 | Kolberg et al. | 16/441 |
| 5,714,701 * | 2/1998 | Hsieh | 84/422.1 |

* cited by examiner

*Primary Examiner*—Robert E. Nappi
*Assistant Examiner*—Shih-yung Hsieh
(74) *Attorney, Agent, or Firm*—Liniak, Berenato, Longacre & White

(57) ABSTRACT

A foot-operated, bass drum pedal assembly is provided with a series of interchangeable cam members selectively disposed on a sprocket hub mounted on the rotating axle disposed between the two upright posts. The interchangeable cam system permits a user to alter the performance characteristics or playing response of the drum pedal system by changing the cam profile for that pedal. The user need not disassemble the entire sprocket and hub assembly; rather, the cam profile is changed by selectively changing a detachable cam member with one of a series of cam members.

15 Claims, 5 Drawing Sheets

DRUM PEDAL SYSTEM WITH INTERCHANGEABLE CAM ELEMENTS

BACKGROUND OF THE INVENTION a) Field of the Invention

This invention relates generally to improvements in bass drum beating equipment; more particularly, the invention provides an enhanced drum pedal system having interchangeable cam profile members for attachment to the drum pedal sprocket to thereby enhance drum performance and versatility.

b) Description of Related Art

Current drum technology includes foot-operated bass drum assemblies wherein the drum pedals are manufactured with a sprocket and hub assembly disposed on a shaft. The sprocket and hub assembly engages a drive chain or strap driven by the pedal. The strap rides along a cam surface to provide a predetermined beater speed and playing response. Each sprocket and hub assembly is provided with a particular cam shape and, thus, a particular playing response.

The cam shape associated with the sprocket and hub assembly directly affects the beater speed for the bass drum. The sprocket and hub assembly mounted on the drum pedal shaft is provided to limit the travel distance of the beater; thus, with the same stepping force acting on the pedal, a user may have different playing response based on the movement of the beater. Conventional drum systems do not provide a convenient and versatile manner for the user to alter the cam shape. Rather, when a user's cam preference changes, that user must either purchase a new pedal system or replace an entire sprocket and hub assembly defining the cam shape.

From this description, it is noted that many kinds of products sold in the market cannot fulfill the requirements of a drum user and, consequently, there is a long and unfulfilled need for a convenient and versatile cam assembly for use in pedal-operated drums and constructed in accordance with the present invention which tends to litigate or obviate the aforementioned problems.

SUMMARY OF THE INVENTION

The present invention provides a unique interchangeable cam system wherein a user may alter the performance characteristics or playing response of a single drum pedal system by changing the cam profile for that pedal. The user need not disassemble the entire sprocket and hub assembly; rather, the cam profile is changed by selectively changing a detachable cam member with one of a series of cam members.

The present invention further provides a unique and efficient connection and disconnection system for quickly and efficiently removing and replacing a cam member on a sprocket assembly of a drum pedal.

The invention is embodied in a foot-operated, bass drum pedal assembly including a horizontally extending support plate, two upright members attached to and supported by the plate, and a horizontal axle supported by the two upright members for rotation about a horizontal axis. A sprocket is carried by the axle at a support location, and the sprocket has peripheral chain engaging portion affixed to a chain. An end portion of the chain is anchored to the sprocket, and the chain has a mid-portion engaging the sprocket along a detachable and interchangeable cam member. A pedal has a rear portion hingedly supported by the plate and a front portion attached to the chain, and the drum beater is rotatably driven by the axle through the sprocket and cam member.

As a result of the interchangeable cam profile member, the reaction speed of the beater in response to pedal movement may be altered and enhanced for more accurately timed drum beating based on the profile of the interchangeable cam member being utilized by the user. The rate of pedal return to the up-position may be changed to more effectively position the pedal for a subsequent, down push, for the next drum beat.

The present invention also provides an infinite number of possible cam profiles without substantially impacting the overall design and performance of the other components of the pedal system.

These and other objects and advantages of the invention, as well as the details of an illustrative embodiment will be more filly understood from the following specification and drawings.

DETAILED DESCRIPTION OF THE PREFERRED EMBODIMENTS

Figure 1:
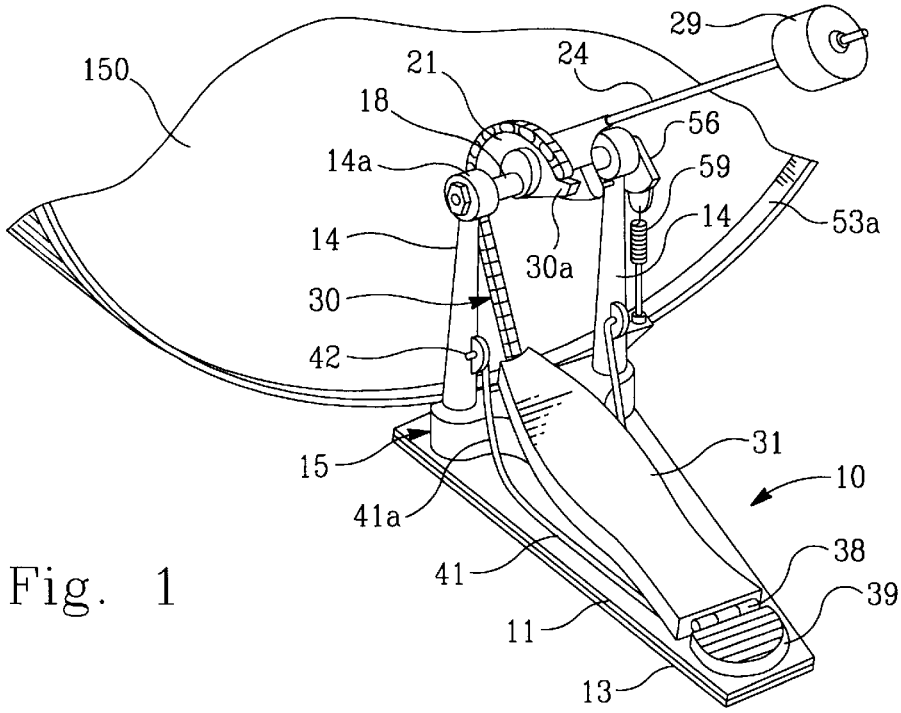
FIG. 1 is a perspective view of drum beating apparatus incorporating the invention.

The foot-operated bass drum pedal assembly 10 illustrated herein includes forwardly longitudinally elongated, horizontal base plate 11 which is relatively heavy and metallic to anchor the device on a floor surface 12. In this regard, the plate may consist of steel, and typically carries an elastomer layer 13 such as rubber on its underside to grip the floor. The underside of layer 13 may be serrated to enhance the grip.

Mounted to the upper side of the plate is a sub-assembly that includes two upright laterally spaced posts 14 interconnected by a bottom yoke plate 15. These elements are also metallic, and are typically made of zinc or steel. The yoke plate is attached to plate 11 by fasteners (not shown).

A horizontal shaft 18 extends laterally between, and is rotatably supported by the two posts, near their upper-most extent; to this end, suitable shaft bearings may be located in the post's enlarged end portions 14*a*. The shaft 18 may be polygonal to mount a sprocket 21, and the sprocket may have a corresponding polygonal bore to closely fit the shaft. A set screw in sprocket 21 engages the shaft to position the sprocket on the shaft. The shaft also carries a drum beater stick or rod 24, via a secondary hub 25 mounted either directly on the shaft 18 or on the sprocket 21. In either instance, the secondary hub 25 is mounted on the shaft 18 in driven relation. A set screw carried by the secondary hub 25 tightens against the rod 24 to adjustably position the rod 24 in the hub 25. A beater head 29 is attached to the opposite and remote end of the rod 24.

Flexible chain 30 has opposite end portions, one of which is anchored to the sprocket at 30*a*, spaced above the base plate and the other of which is anchored to the pedal 31 at portion 31*a*. The forwardly elongated pedal extends in inclined relation above the base plate, and the forward portion 31*a* of the pedal is attached to the lower end of the chain dependent below the forwardmost extent of the sprocket. The chain is displaced downwardly as the pedal is pressed downwardly, thereby rotating the sprocket, shaft, and beater, to beat the bass drum 150.

Figure 3B:
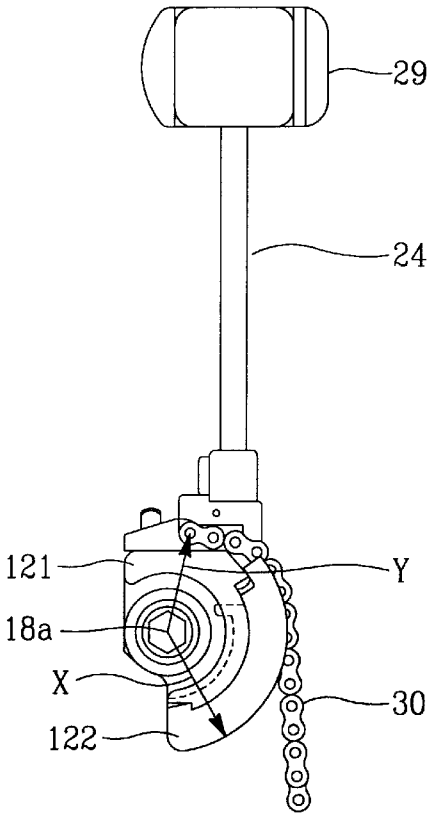
FIGS. 3*a* and 3*b* are exploded side views of the hub assembly as a first interchangeable cam member is being attached to the hub assembly via a tongue and groove type connection.

It will be noted that the axis of rotation 18*a* of the sprocket and axle shaft 18 are eccentric relative to the outer cam member 22 mounted on the sprocket 21 engaged by the chain 30. In particular, the chain 30 has a mid-portion 30*b* engaging the outer cam surface of the cam member 22, and being at progressively increasing distance (compare larger distance X with lesser distance Y, for example, in FIG. 3*b*) from the axis 18*a*, along the chain length in a direction toward the forward portion 31*a* of the pedal 31. As a result, the pedal accelerates faster the travel of the beater toward the drum, as during initial rotation of the sprocket by the chain, due to the longer torque arms, of which distance X is representative, relative to the shorter torque arms (e.g., Y) which are in effect as the sprocket completes its rotation and as the beater closely approaches the drum. This also enables more accurate timing of drum beating. Also, the cam effect serves to move forwardly the chain extent hanging below the sprocket, as the sprocket returns to the starting position, thereby bringing the pedal up faster than if the sprocket rotated about its true center.

Figure 2:
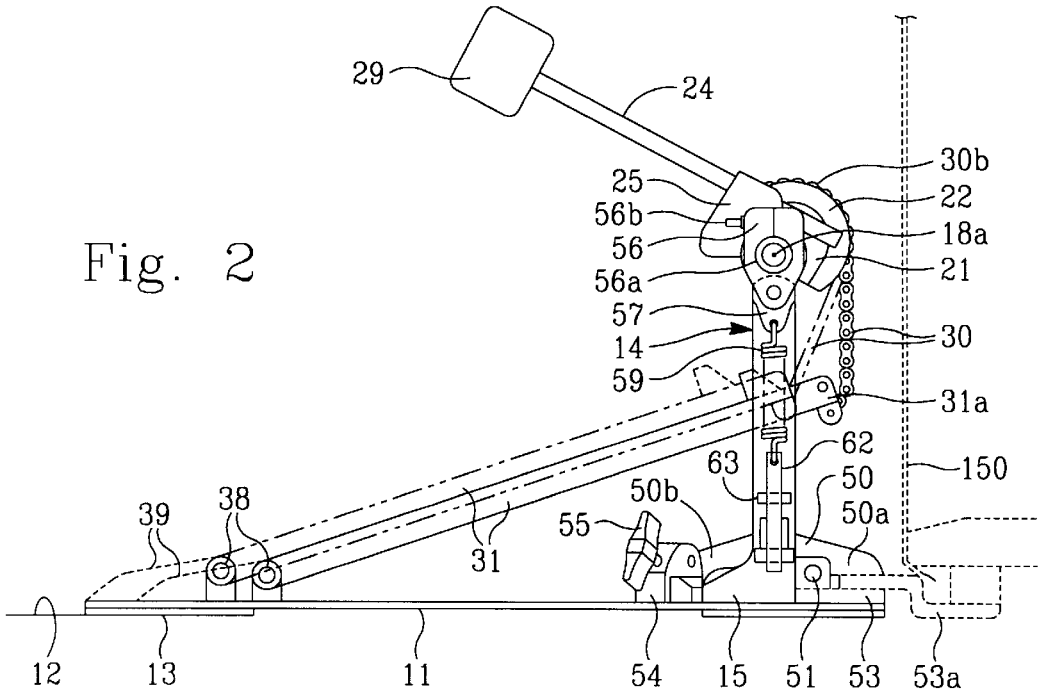
FIG. 2 is a side elevation showing the FIG. 1 apparatus.

In the preferred embodiment of this invention, the heel plate 39 may be adjusted relative to the horizontal base plate 11 to one of a plurality of positions as shown in FIG. 2. By shifting the heel plate 39 forward or back, the leverage and thus the feel of the pedal is altered from light, medium, and heavy to suit the player's personal playing style. The specific feature of the adjustable heel plate are set forth in U.S. Pat. No. 5,574,237 which is hereby incorporated by reference.

In the pedal design shown in FIG. 1 where the heel plate is not moveable, two support struts 41 in the form of steel rods may extend forwardly from the heel pad 39 in which they are embedded. The struts extend along the upper surface of the base plate, and then upwardly at 41*a* at a forward angle to connect to the two posts, at connection 42, for bracing same.

A clamp finger 50 is rotatably carried by the yoke 15 at lateral pivot locations 51. The yoke also has tongues 53 that extend forwardly beneath the level of the clamp finger, and at laterally opposite sides thereof, the tongues supported by the base plate. In use, the tongues support the downwardly convex lower side of the bass drum rim 53*a*. The upper side of the rim is downwardly clamped by the forward portion 50*a* of the finger 50. An adjusting mechanism such as a set screw threaded through the rearward extent 50*b* adjusts the clamping force of the finger 50. In the preferred embodiment of FIG. 2, an offset adjustment mechanism 54 having a wingnut 55 that adjusts a lever force acting on the finger 50. The specific features and arrangement of the offset adjustment mechanism 54 is described in U.S. Pat. No. 5,726,370 which is hereby incorporated by references.

Shaft 18 has an end portion that projects through one of the pedestals and to which a cylindrical fitting 56*a* is attached. A crank 56 is attached to the cylindrical fitting 56*a* by a bolt 56*b*. By adjusting the bolt 56*b*, the crank 56 can be positioned forwardly and rearwardly thus achieving infinite angling possibilities of the beater 29 relative to the drum head 150. A pivoting connector 57 is integrated into the crank assembly onto which one end of the spring 59 is connected. A threaded connector 62 attached to the lower end of the spring is rotatable in a opening in a lug 63 on the pedestal, to adjust the spring tension.

Accordingly, a sturdy, compact, reliable and more accurate pedal unit is provided.

Figure 3A:
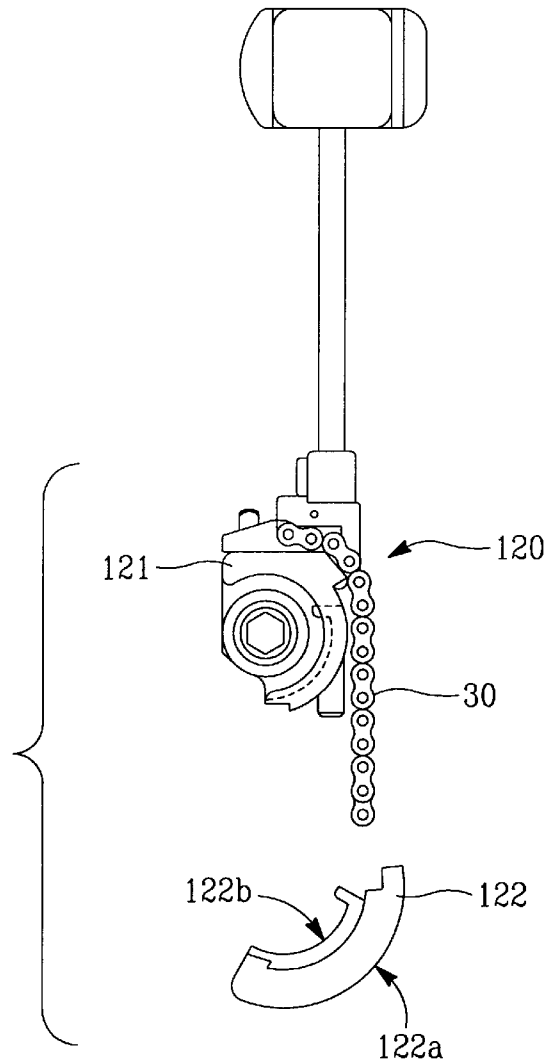

With reference to FIGS. 3*a* through 7, the interchangeable cam system of this invention will now be described. As shown in FIGS. 3*a* and 3*b*, the sprocket 120 is formed as a two piece It member comprising a hub portion 121 and a removable (interchangeable) cam portion 122. The cam portion 122 is formed with an outer cam surface 122*a* and an inner fastening section 122*b* that matingly engages the hub portion 121 through a tongue-and-groove snap-fit system.

The profile of the cam portion 122 is designed to provide a predetermined performance characteristics and playing response for the beater and drum. With this invention, the cam profile may be selectively changed by the user to suit the style and ability of the user. Depending on the cam profile affixed to the sprocket hub 121, the pedal accelerates or decelerates the travel of the beater toward the drum, as during initial rotation of the sprocket by the chain, due to the variable torque arms (see distance X) relative to the shorter torque arms (see distance Y) which are in effect as the sprocket completes its rotation and as the beater closely approaches the drum. This also enables more accurate timing of drum beating. Also, the cam effect serves to alter chain extent hanging below the sprocket, as the chain returns to the sprocket, thereby bringing the pedal up faster than if the sprocket rotated about its true center.

Figure 4B:
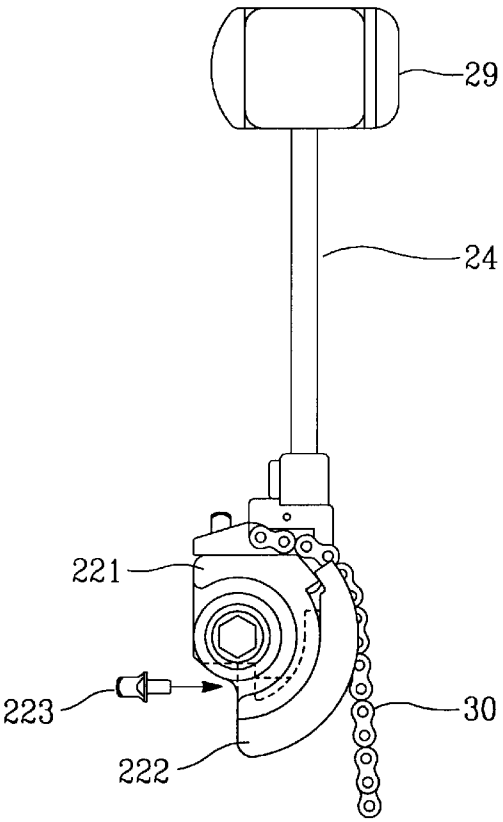
FIGS. 4*a* and 4*b* are exploded side views of the hub assembly as another interchangeable cam member is being attached to the hub assembly via a bolt type connection.
Figure 4A:
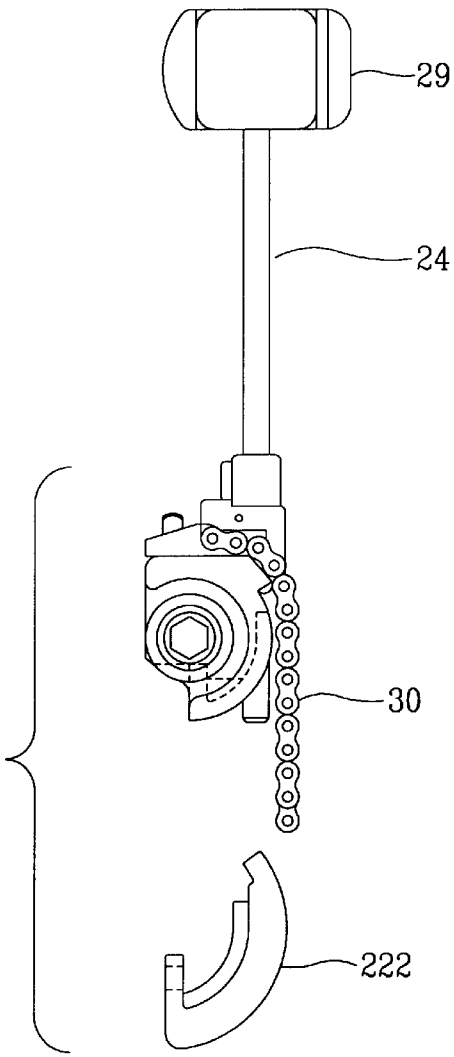
Figure 6:
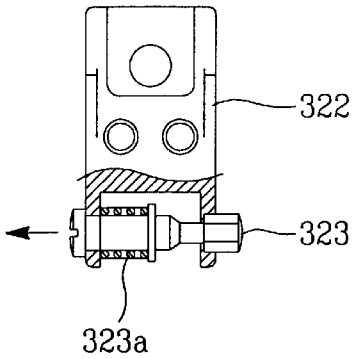
FIG. 6 is a partial cross sectional view of the push-to-release type cam fastener shown in FIGS. 5*a* and 5*b;*
Figure 5B:
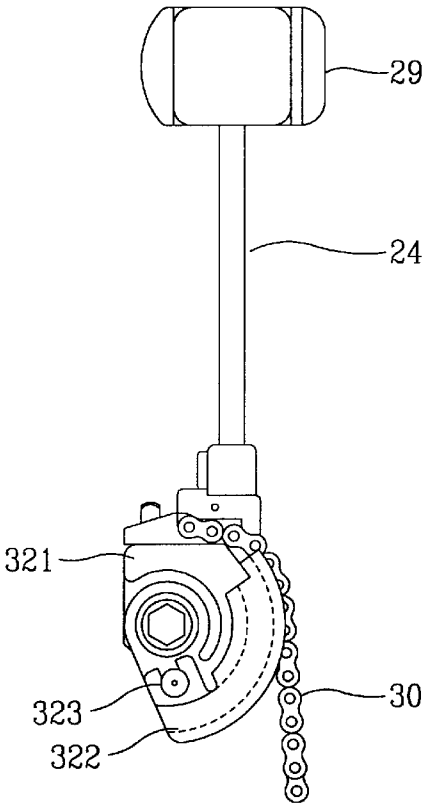
FIGS. 5*a* and 5*b* are exploded side views of the hub assembly as another interchangeable cam member is being attached to the hub assembly via a push-to-release type connection.
Figure 5A:
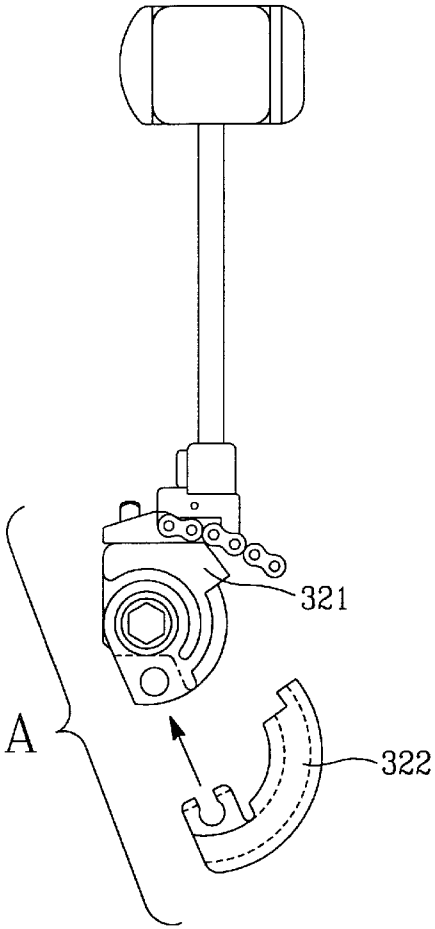

Although the cam and sprocket assembly of FIG. 3 shows a particular fastening system, this invention should not be limited to any particular fastening system. FIGS. 4*a* and 4*b* show an alternative arrangement wherein a bolt 223 secures the cam portion 222 to the hub portion 221. Likewise, FIGS. 5*a* and 5*b* show a push-release fastening arrangement for the interchangeable cam system of this invention. In FIGS. 5*a* and 5*b*, a spring-loaded pin-type fastener 323 secures the cam portion 322 to the hub portion 321, and a spring 323*a* biases the fastener 323 into the locking position. FIG. 6 is a partial cross sectional view of the push-release type cam fastener shown in FIGS. 5*a* and 5*b*.

Figure 7A:
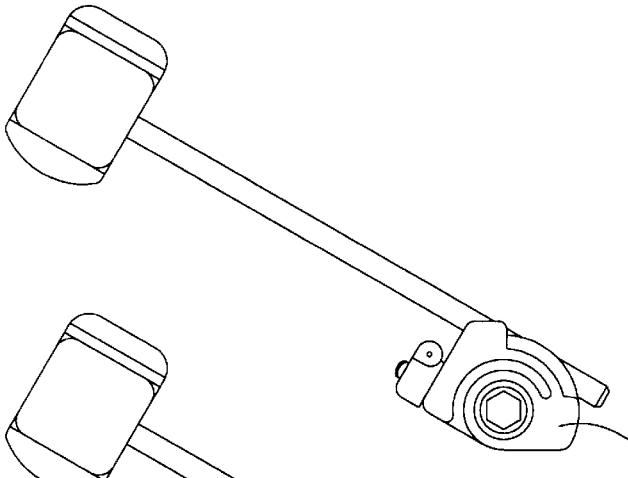
FIGS. 7*a*–7*e* shown the hub assembly of this invention with no cam member disposed thereon, as well as four different side views showing four different cam profiles selectively attached to the same hub assembly as envisioned by this invention.
Figure 7B:
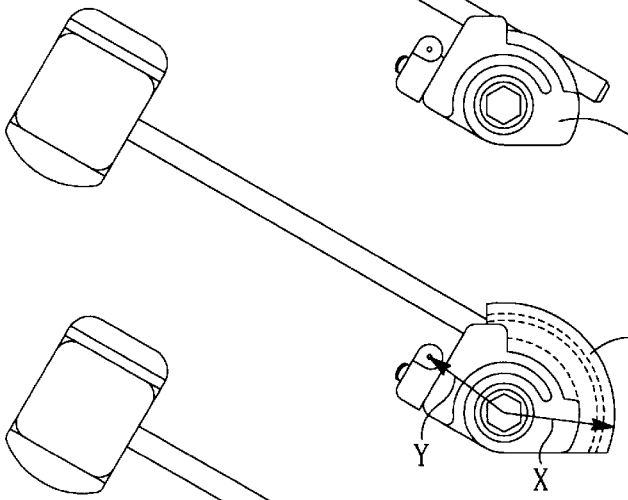
Figure 7C:
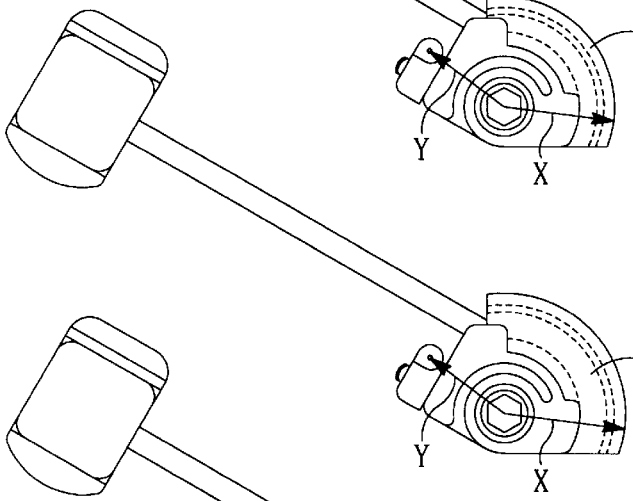
Figure 7D:
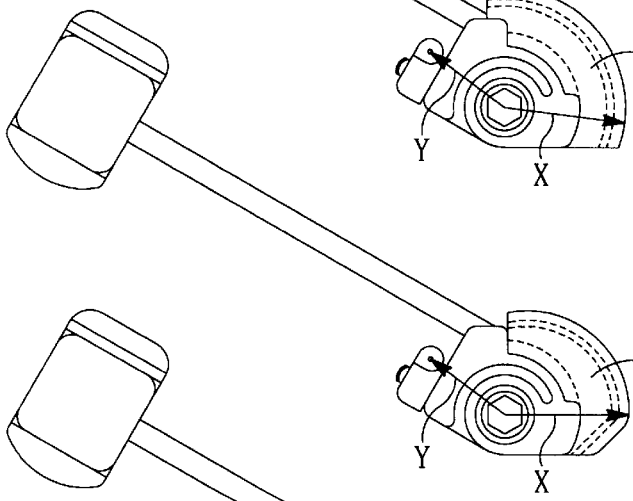
Figure 7E:
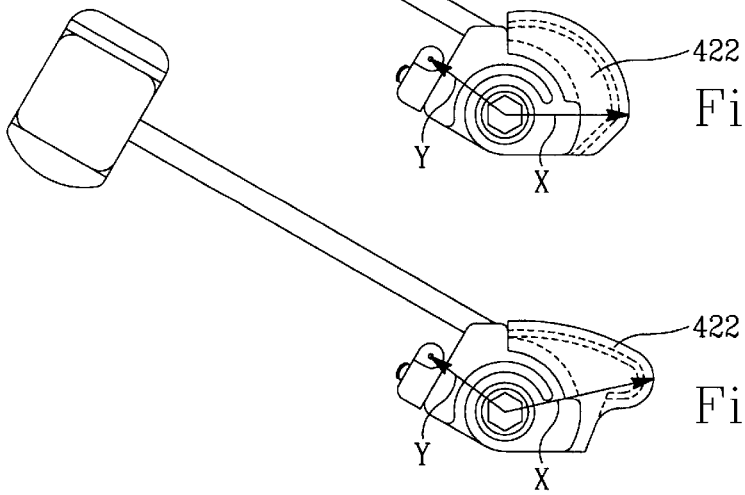

As shown in FIGS. 7*b* through 7*e*, the present invention encompasses a wide variety of interchangeable cam profiles having different performance characteristics for the beater system. FIG. 7*a* shows the hub portion 421 absent any cam portion. FIGS. 7*b*–7*e* shows four different cam portions 422 exemplifying the modular and interchangeable nature of the cam system of this invention. Depending on the particular cam profile employed by the user, the effective length of the torque arm changes at different rates to provide different performance characteristics.

While the foregoing invention has been shown and described with reference to a number of preferred embodiments, it will be understood by those having skill in the art that various changes in form and detail may be made therein without departing from the spirit and scope of this invention.

What is claimed is:

1. A drum pedal system for beating a drum with a foot-actuated beater mechanism, said system comprising:

a pedal member adapted to be actuated by a foot of a user;

a sprocket member mounted to pivot about an axis of rotation, said sprocket member comprising a sprocket hub mounted on an axle and a first cam profile member detachably connected to said sprocket hub;

a drive linkage drivingly connecting said pedal member with said sprocket member;

a pivoting beater member driven by said pedal member and adapted to pivot toward a striking surface of a drum; and at one additional cam profile member that is interchangeable with said first cam profile member to thereby provide a plurality of cam profiles interchangeably fitted onto said sprocket hub;

wherein said first cam profile member is removable from said sprocket hub while said sprocket hub remains affixed to said axle to thereby provide an interchangeable cam profile arrangement.

2. The drum pedal system of claim 1, further comprising a threaded fastener connecting said cam profile member to said sprocket hub.

3. The drum pedal system of claim 1, further comprising a press-to-release pin member connecting said cam profile member to said sprocket hub.

4. The drum pedal system of claim 1, wherein said drive linkage overlies a portion of said cam profile member to define a torque arm exerted on said sprocket member when said pedal member is moved down to thereby cause said beater member to pivot toward said striking surface.

5. A drum pedal system for beating a drum with a foot-actuated beater mechanism, said system comprising:

a pedal member adapted to be actuated by a foot of a user;

a sprocket member mounted to pivot about an axis of rotation, said sprocket member comprising a sprocket hub mounted on an axle and a first cam profile member detachably connected to said sprocket hub;

a drive linkage drivingly connecting said pedal member with said sprocket member;

a pivoting beater member driven by said pedal member and adapted to pivot toward a striking surface of a drum;

wherein said first cam profile member is removable from said sprocket hub while said sprocket hub remains affixed to said axle to thereby provide an interchangeable cam profile arrangement, and wherein, said cam profile member is connected to said sprocket hub via a snap-fit connection.

6. A drum pedal system for beating a drum with a footactuated beater mechanism, said system comprising:

a pedal member adapted to be actuated by a foot of a user;

a sprocket member mounted to pivot about an axis of rotation, said sprocket member comprising a sprocket hub mounted on an axle and a first cam profile member detachably connected to said sprocket hub;

a drive linkage drivingly connecting said pedal member with said sprocket member;

a pivoting beater member driven by said pedal member and adapted to pivot toward a striking surface of a drum;

wherein said first cam profile member is removable from said sprocket hub while said sprocket hub remains affixed to said axle to thereby provide an interchangeable cam profile arrangement, and wherein, as the pedal member moves down causing the beater member to pivot toward the striking surface, an effective length of a torque arm exerted on the sprocket member by the drive linkage initially increases then rapidly decreases as the pedal member moves down.

7. The drum pedal system of claim 6, wherein said effective length gradually decrease as the pedal member moves down.

8. A sprocket member assembly for a foot actuated pedal system for beating a drum, said sprocket member comprising:

a sprocket hub comprising an aperture sized to receive a pivot axle passing therethrough, said sprocket hub pivoting about an axis of rotation defined by said pivot axle during operation;

a plurality of cam profile members selectively and interchangeably connected to said sprocket hub, each said cam profile members having a different predetermined outer cam surface at least partially circumscribing said axis of rotation.

9. The sprocket member assembly of claim 8, wherein said outer cam surface defines a torque arm exerted on said sprocket member when a drive force is applied to said sprocket member to pivot a beater member toward a striking surface of said drum.

10. The sprocket member assembly of claim 9, farther comprising a drive linkage connected to said sprocket hub and overlying said outer cam surface to thereby define said torque arm when a tension is applied to said drive linkage.

11. The sprocket member assembly of claim 8, further comprising a predetermined disconnection interface between said sprocket hub and each of said cam profile members, said disconnection interface providing a selective disconnection mechanism to permit removal of each said cam profile members from said sprocket hub.

12. The sprocket member assembly of claim 8, wherein each said cam profile members is connected to said sprocket hub via a snap-fit connection.

13. The sprocket member assembly of claim 8, further comprising a threaded fastener connecting each said cam profile members to said sprocket hub.

14. The sprocket member assembly of claim 8, further comprising a press-to-release pin member connecting each said cam profile members to said sprocket hub.

15. A drum pedal kit for providing a versatile foot-actuated beater mechanism, said kit comprising:

a pedal member adapted to be actuated by a foot of a user;

a sprocket member mounted to pivot about an axis of rotation, said sprocket member comprising a sprocket hub mounted on an axle and a plurality of cam profile members interchangeably connected to said sprocket hub, each cam profile member comprising an outer cam surface that defines a varying torque arm exerted on said sprocket member when a drive force is applied to said sprocket member;

a drive linkage drivingly connecting said pedal member to said sprocket member to thereby provide said drive force to said sprocket member;

a pivoting beater member driven by said pedal member and to pivot toward a striking surface of a drum;

wherein a user may selectively connect one of said plurality of cam profile members to said sprocket hub to thereby provide a different performance characteristic for said foot-actuated beater mechanism.

* * * * *

UNITED STATES PATENT AND TRADEMARK OFFICE

CERTIFICATE OF CORRECTION

PATENT NO. : 6,172,291 B1
DATED : January 9, 2001
INVENTOR(S) : Takegawa

It is certified that error appears in the above-identified patent and that said Letters Patent is hereby corrected as shown below:

Column 4,
Line 69, change "at one additional" to -- at least one additional --.

Signed and Sealed this

Sixth Day of May, 2003

JAMES E. ROGAN
*Director of the United States Patent and Trademark Office*